US007004573B2

(12) United States Patent
Hewitt

(10) Patent No.: US 7,004,573 B2
(45) Date of Patent: Feb. 28, 2006

(54) INK SUPPLY SYSTEM

(75) Inventor: Garry Hewitt, Wantirna (AU)

(73) Assignee: Mikoh Imaging Systems PTY LTD, New South Wales (AU)

( * ) Notice: Subject to any disclaimer, the term of this patent is extended or adjusted under 35 U.S.C. 154(b) by 149 days.

(21) Appl. No.: 10/276,478

(22) PCT Filed: May 16, 2001

(86) PCT No.: PCT/AU01/00559

§ 371 (c)(1),
(2), (4) Date: Sep. 2, 2003

(87) PCT Pub. No.: WO01/87624

PCT Pub. Date: Nov. 22, 2001

(65) Prior Publication Data

US 2004/0027426 A1 Feb. 12, 2004

(30) Foreign Application Priority Data

May 16, 2000 (AU) ..... PQ7563

(51) Int. Cl.
*B41J 2/175* (2006.01)

(52) U.S. Cl. ..... 347/85; 347/87

(58) Field of Classification Search ..... 347/13, 347/14, 84, 85, 86, 87; 141/2, 18
See application file for complete search history.

(56) References Cited

U.S. PATENT DOCUMENTS 4,342,042 A * 7/1982 Cruz-Uribe et al. ..... 347/7
4,476,472 A * 10/1984 Aiba et al. ..... 347/86
4,677,448 A * 6/1987 Mizusawa et al. ..... 347/85
5,367,328 A * 11/1994 Erickson ..... 347/7
5,489,925 A * 2/1996 Brooks et al. ..... 347/6
5,969,735 A * 10/1999 Haigo ..... 347/85
6,007,193 A 12/1999 Kashimura et al.
6,022,102 A * 2/2000 Ikkatai et al. ..... 347/85
6,058,984 A * 5/2000 Sato ..... 141/7
6,234,615 B1 * 5/2001 Tsukuda ..... 347/85
6,264,312 B1 * 7/2001 Koitabashi et al. ..... 347/85

FOREIGN PATENT DOCUMENTS

EP 0 443 798 A2 8/1991
EP 0 791 466 A2 8/1997
EP 0 803 364 A2 8/1997
EP 0 872 346 A1 10/1998
JP 59222361 12/1984
JP 58-098258 A * 6/1993 ..... 347/85
JP 1113889 5/1999
JP 11138850 5/1999
JP 11138850 A 5/1999

OTHER PUBLICATIONS

International Search Report for PCT/AU01/00559 issued by the Australian Patent Office on Jun. 15, 2001.
International Examination Report for PCT/AU01/00559 issued by the Australian Patent Office Jan. 30, 2002.

* cited by examiner

*Primary Examiner*—Anh T. N. Vo
(74) *Attorney, Agent, or Firm*—Fitch, Even, Tabin & Flannery

(57) ABSTRACT

An ink supply system for use with high speed multiple layer form collators includes a first ink supply reservoir in fluid communication with a second ink supply reservoir, and a pump to enable flow of ink from the first ink supply reservoir to the second ink supply reservoir. The second ink supply reservoir supplies ink to a print head. The second ink supply reservoir is divided into an inlet chamber into which ink from the first ink supply reservoir is received, an outlet chamber, the outlet chamber having a one or more outlets leading to print heads, and an overflow chamber. Internal partitions within the second ink supply reservoir ensure that the inlet chamber fills before overflowing into the outlet chamber and that the outlet chamber overflows into the overflow chamber. Ink settles in the inlet and outlet chambers thus allowing any turbulence to dissipate. A constant head pressure in the outlet chamber promotes constant ink flow and even print density.

20 Claims, 8 Drawing Sheets

INK SUPPLY SYSTEM

The present invention relates to an ink supply system.

The ink supply system of the present invention is used in connection with high-speed ink jet printing equipment, particularly with multi-head printing systems.

BACKGROUND OF THE INVENTION

A typical print head used in high-speed ink jet printing produces a print width of 17.mm, that is, 128 pixels. For wider print operations a print head can be moved across the paper. Alternatively, an array of print heads can be arranged in an array across the paper to create the desired print width.

Where a single print head is used and is moved across the paper difficulties can arise as a result of mechanical malfunction that interrupts ink flow or indeed the whole of the printing operation.

Where a multiple print head array is used, ink has to be supplied to each print head to ensure printing occurs. To produce a smooth acceptably even print quality an evenly regulated supply of ink to each of the print heads is preferred. It is desirable that the print head array should produce print of an even intensity in all directions—that is, not only across the paper from one print head to the next, but down the length of the paper. In other words it is preferred that the print intensity should remain constant over time and not be subject to any gradual fading or loss of intensity.

The present invention is directed to the above situation and provides an ink supply system for use with print heads with a constant ink flow that can be used with single head print systems or with multiple head print systems.

SUMMARY OF THE INVENTION

Therefore, according to a first aspect of the present invention, although this need not be the broadest, nor indeed the only aspect of the invention, there is provided an ink supply system including:

a first ink supply reservoir, said first ink reservoir being in fluid communication with a second ink supply reservoir, pump means associated with said first and second ink supply reservoirs to enable flow of ink from the first ink supply reservoir to the second ink supply reservoir;

said second ink supply reservoir serving to supply ink to a print head, said second ink supply reservoir including an inlet chamber into which ink from the first ink supply reservoir is received and an outlet chamber, the outlet chamber having a plurality of outlets, each outlets being adapted to supply ink to a respective print head;

said inlet and outlet chambers being arranged such that a constant level of liquid can be maintained in the outlet chamber during use.

The arrangement of the invention has been developed so as to produce an even ink flow to the print heads.

By arranging for a pumped supply of ink from the first ink supply reservoir the turbulence difficulties and flow variability associated with gravity flow can be avoided. The inlet chamber of the second ink supply reservoir effectively serves as a settling chamber allowing any turbulence and air bubbles in the liquid to be dissipated before the ink is delivered into the outlet chamber for subsequent delivery to print heads.

By arranging for a constant level of liquid to be maintained in the outlet chamber the head pressure exerted on each outlet is the same and moreover, the head pressure does not vary over time, irrespective of the level of liquid in the first ink supply reservoir. In current systems ink is fed under gravity from a storage container to a print head. In such a system, the head pressure on the ink diminishes as the container gradually empties. This has an impact on the print intensity and thus the overall print quality. Thus as the ink container empties the pressure of liquid on the print head diminishes and the intensity of the printed image is correspondingly diminishes as the ink supply to the head falls away.

The constant liquid level is maintained in a preferred embodiment by including a third chamber, an overflow chamber, in the second ink supply reservoir. The overflow chamber is position adjacent the outlet chamber and a barrier between the outlet and overflow chambers establishes the upper level of the outlet chamber, ink being allowed to flow over the barrier to the overflow chamber.

The pumping means is preferably a diaphragm pump and an in line filter is included positioned between the first ink supply reservoir and the second ink supply reservoir.

Preferably, the ink level in the ink supply system is maintained at a constant level with respect to the height of the print heads. To ensure that this relationship is secure, and accommodates any changes in the height of the print head the ink supply and the print head can be held on a printing station on a common arm. Thus, the height of the arm may be adjustable with respect to the pedestal on which the arm is mounted without alteration of the relative heights of the ink level and the level of the print heads.

In a preferred embodiment of the invention the ink supply system has a respective outlet for each of up to 20 print heads held in a print head array. Thus, the ink supply system of the present invention enables printing up to a width of 348 mm.

In a further aspect of the present invention there is provided a modular printing station adapted for use with a single or multi-layer high speed printer, said modular printing station comprising a support pedestal having an ink supply system and an array of print heads mounted adjustably thereon such that a constant level relationship is maintained between the ink supply and the print heads, the print head array being slidably movable between operational and non operational positions, wherein, in an operational position, the print head array is received in a print station mounted on an existing paper flow collator.

In one form of the invention a plurality of modular printing stations and associated station receiving assembles are mounted on a multi-sheet form collator to enable high-speed multi-layer printing.

The print head array is preferably a planar sheet having an array of mounting sites therein a single mounting site serving for each print head and a print head being secured therein by means of a respective print head carrier. Preferably the array includes a number of columns of print heads each aligned with a print directions successive column being staggered with respect to a preceding column to produce an unbroken print line.

In an alternative embodiment, the print head array can be arranged as a plurality of columns, each column being staggered with respect to the preceding column and being arranged at an angle of between 25–65° to the print direction.

BRIEF DESCRIPTION OF THE DRAWINGS

The present invention will now be described with reference to the accompanying drawings in which.

DESCRIPTION OF THE PREFERRED EMBODIMENT

Figure 1:
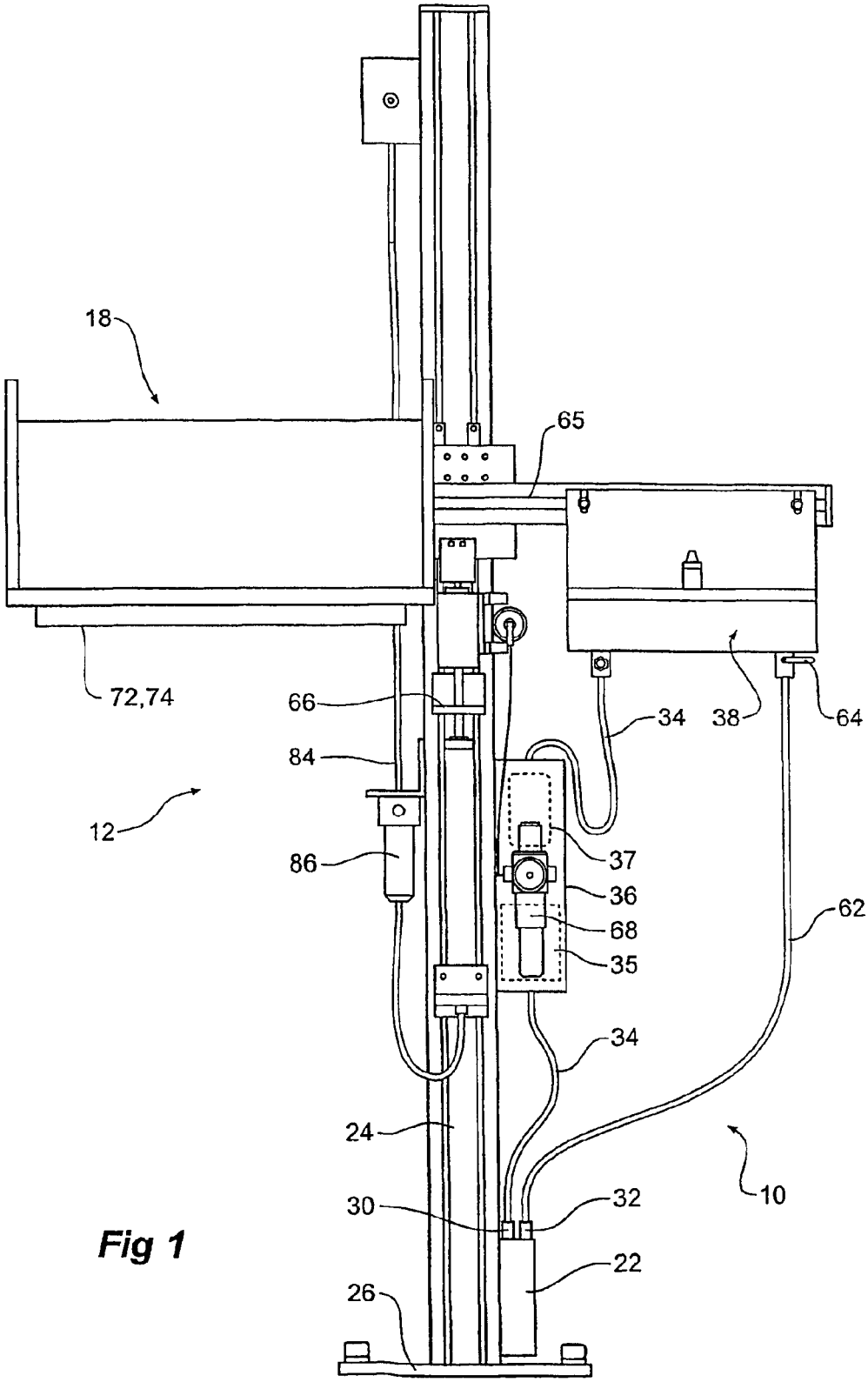
FIG. 1 illustrates in front view a print station assembly incorporating an ink supply system in accordance with a first aspect of the present invention.
Figure 2:
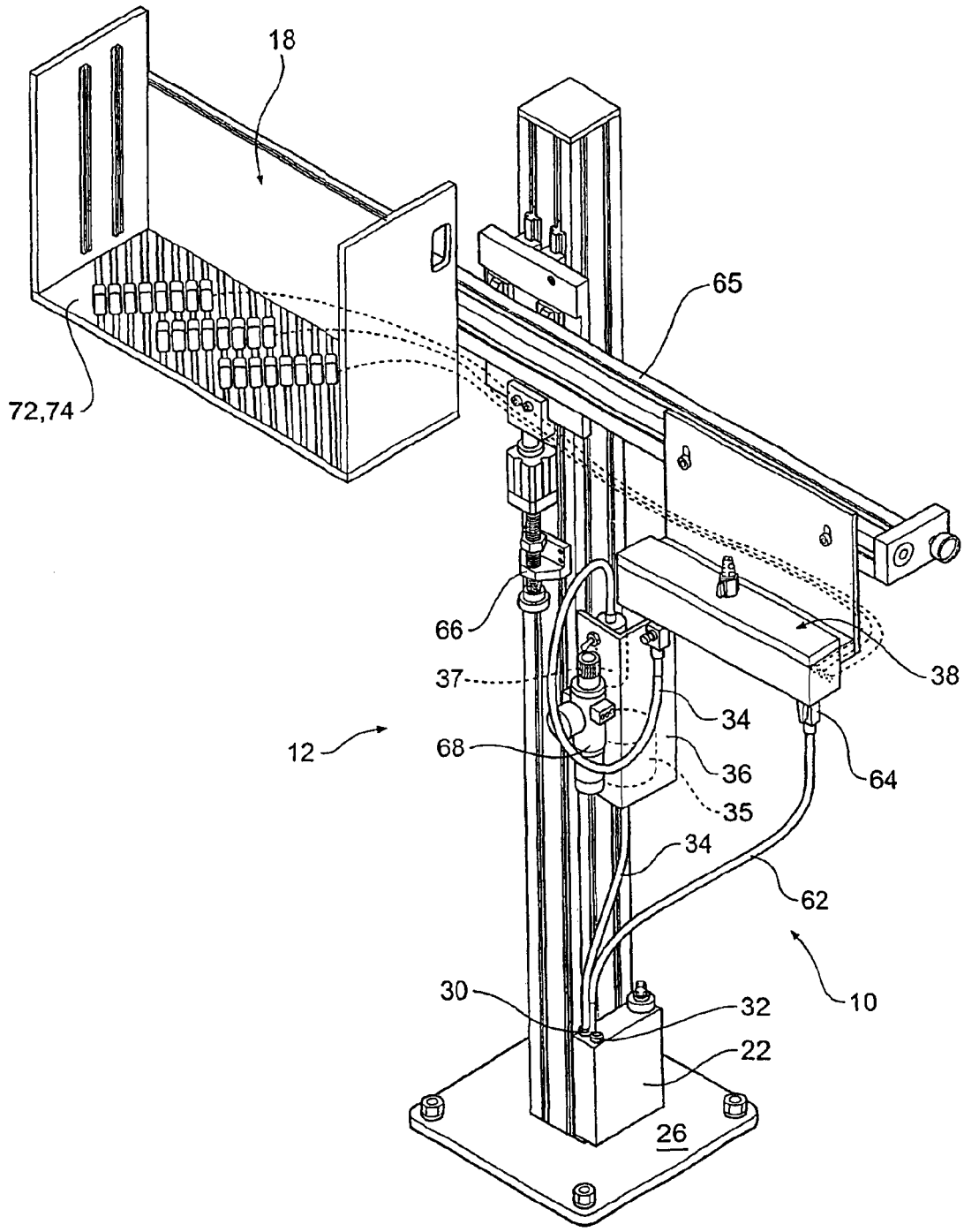
FIG. 2 illustrates the print station assembly of FIG. 1 in perspective view.

Shown in FIGS. 1 and 2 is an ink supply system 10 in accordance with the invention mounted on a print station 12. The print station 12 is used in connection with a form collator generally indicated at 14. In use, typically, a plurality of print stations 12 may be accommodated on a monorail system associated with the form collator 14. The arrangement of a number of print stations 12 together with the form collator 14 enables printing on a number of separate sheet layers which are collated and mechanically handled by the collator 14 in known manner. The form collator 14 will not be further described herein.

The ink supply system 10 is designed to supply ink to print unit 18. As will be described herein a separate ink supply is made to each print head 20 in the print unit 18.

The ink supply system 10 is mounted on a pedestal 24 of the print station 12. The pedestal 24 is suitable for mounting onto a carrier such as a monorail system. In alternative embodiments the pedestal 24 may be secured to a floor surface. The ink supply system 10 includes a first ink supply reservoir 22 mounted at a base 26 of the print station 12 adjacent the pedestal 24. The ink supply reservoir 22 is an ink container and may in fact be an ink container as supplied by the manufacturer thereof, or, alternatively can be a separate unit filled with ink as required by the printer.

The ink supply reservoir 22 has two uppermost openings, being an outlet 30 and a return inlet 32. The ink reservoir 22 is also provided with a breather valve 33 that serves to allow air into the reservoir 22 as ink is gradually withdrawn thereby allowing an even pressure to be maintained within the reservoir.

Extending from the outlet 30 is a supply line 34 which travels upwardly to a pump, generally indicated at 35 located within a housing 36. The pump 35 is a diaphragm pump selected for its ability to produce an even flow. In operative conditions the pump 35 serves to produce a flow of ink upwardly through the supply line 34 from the ink supply reservoir 22 through the pump 35. On the out flow side of the pump 35 and also located in the housing 36 is an inline filter 37. The inline filter 37 serves to remove any fine particulates from the ink flow in the supply line 34. Typically, the filter 37 operates to remove any particulates having a diameter greater than 4 microns.

The supply line 34 exits the pump 35 and enters a second ink supply reservoir 38 through a base thereof.

The second ink supply reservoir 38 is shown in greater detail in FIGS. 4–7. The second ink supply consists generally of a rectangular chamber having a number of internal divisions and a securing cover.

As can be seen the second ink supply reservoir 38 is divided into a number of chambers. Separated by internal partitions within the body of the reservoir. An inlet chamber 40 is in fluid communication with the supply line 34. The inlet chamber 40 is located to one side of the supply reservoir 38 and separated from the remainder of the reservoir by a partition 42. The partition 42 extends to an upper edge of the side walls of the reservoir 38 leaving only a small gap 44 that allows for gentle overflow from the inlet chamber 40 to an adjacent outlet chamber 46.

As can be seen from the drawings the inlet chamber 40 occupies a substantial amount of space and therefore holds a substantial volume of ink. The chamber 40 needs to be virtually full before any ink flows into the outlet chamber 46. Accordingly, under normal flow conditions the dwell time for any ink held in the inlet chamber 40 is substantial. Thus, the inlet chamber 40 serves as a settling chamber allowing any turbulence in flow resulting from the pumping of the ink. Further, any air bubbles entrained in the ink can be removed from the ink at this time.

As the level of liquid in the chamber 40 rises and overflows the partition 42 into the outlet chamber 46 an even flow of liquid with minimal turbulence into the outlet chamber 46 is achieved.

The outlet chamber 46 is an elongate chamber located at a rear of the ink supply reservoir 38. The outlet chamber 46 contains in an outer wall a plurality of outlet openings 50. Each outlet opening 50 has attached thereto an outlet supply line 52 that terminates in a connection to a respective print head 54. There are 20 outlet openings 50 in the outlet chamber 46 enabling a fluid connection to be made to up to 20 print heads 20. Where less than 20 print heads are in operation those outlets openings not required can simply be plugged.

It will be observed that the outlet openings are aligned horizontally and are found at the base of the outlet chamber 46.

Figure 3:
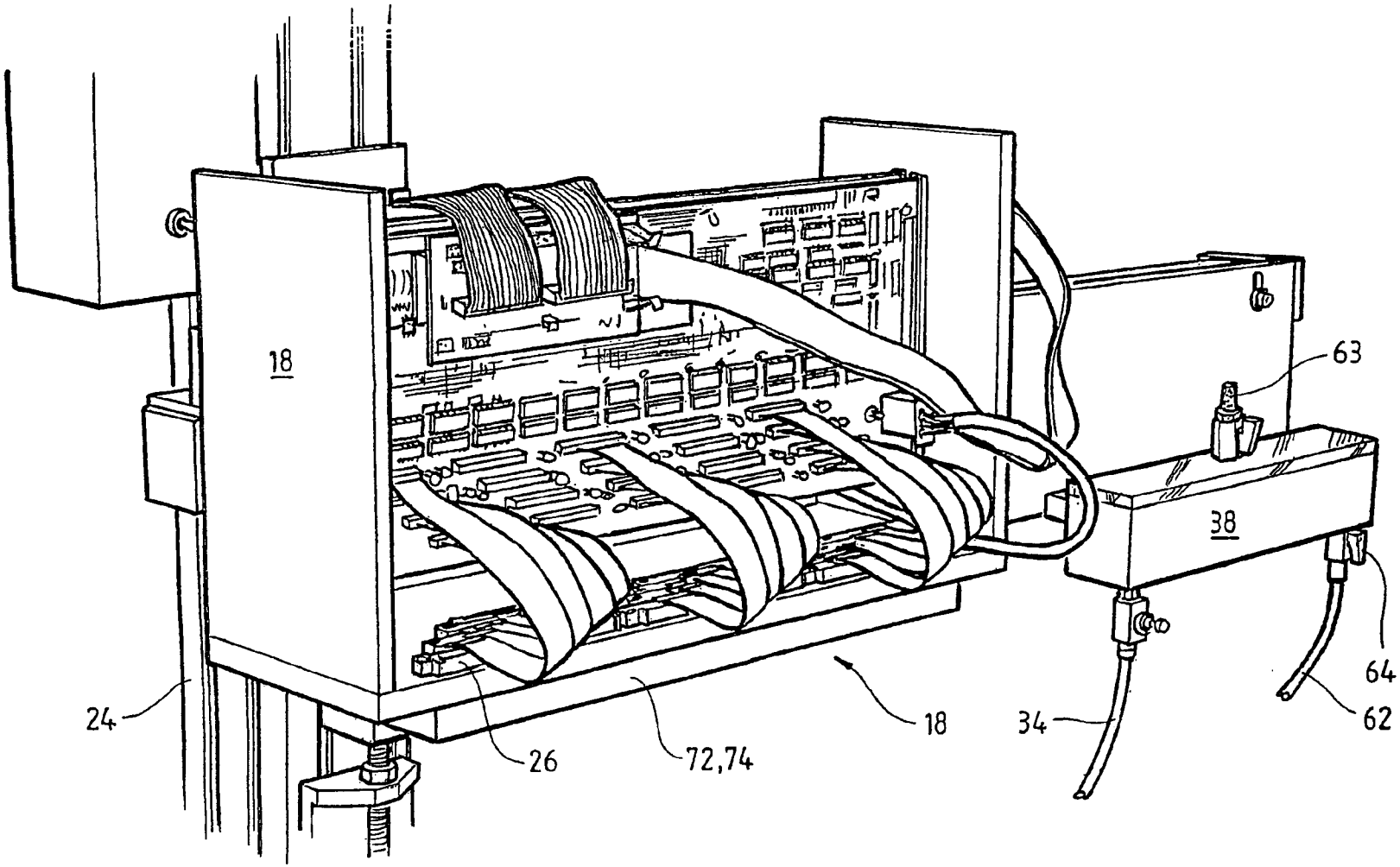
FIG. 3 illustrates a rear view of an upper portion of the print station assembly of FIG. 1.
Figure 4:
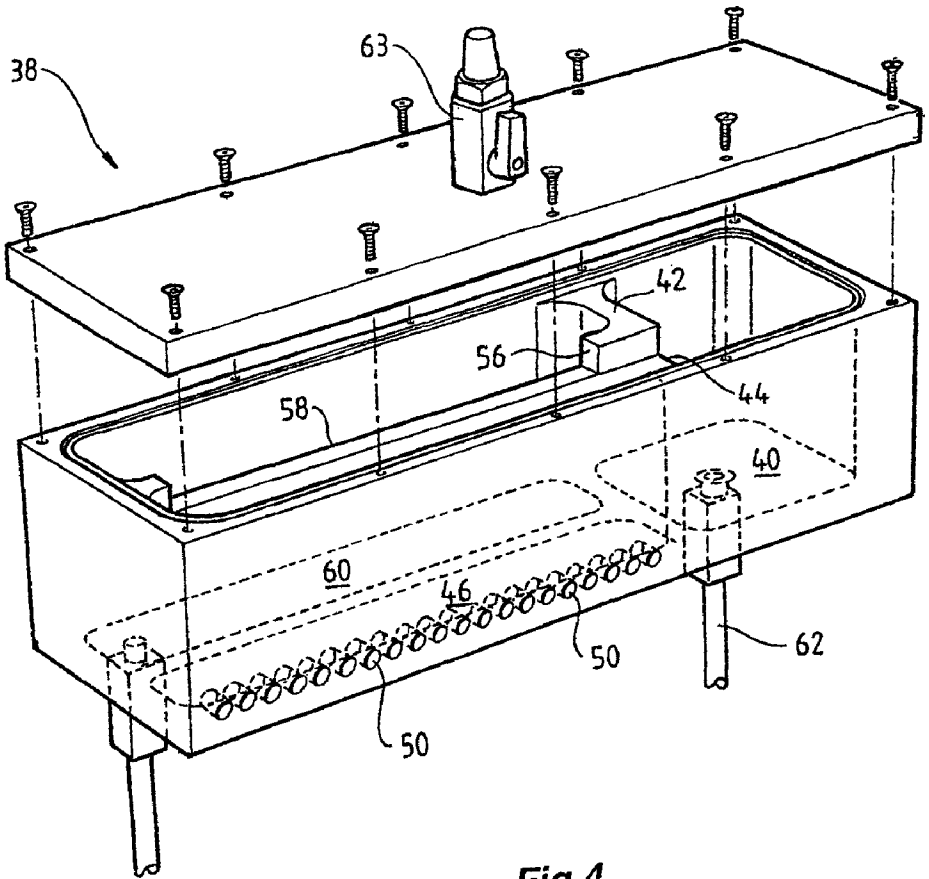
FIG. 4 illustrates a second ink supply reservoir used in the ink supply system shown in FIG. 1.
Figure 5:
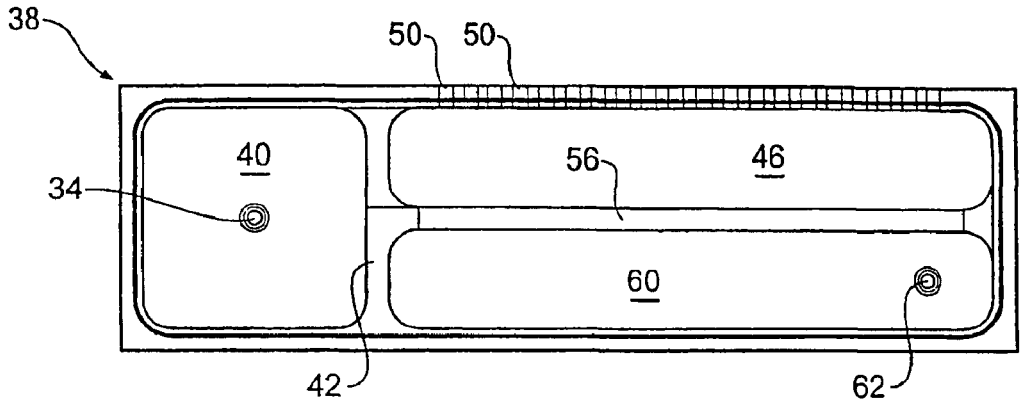
FIG. 5 illustrates in plan view the second ink supply reservoir of FIG. 2.
Figure 6:
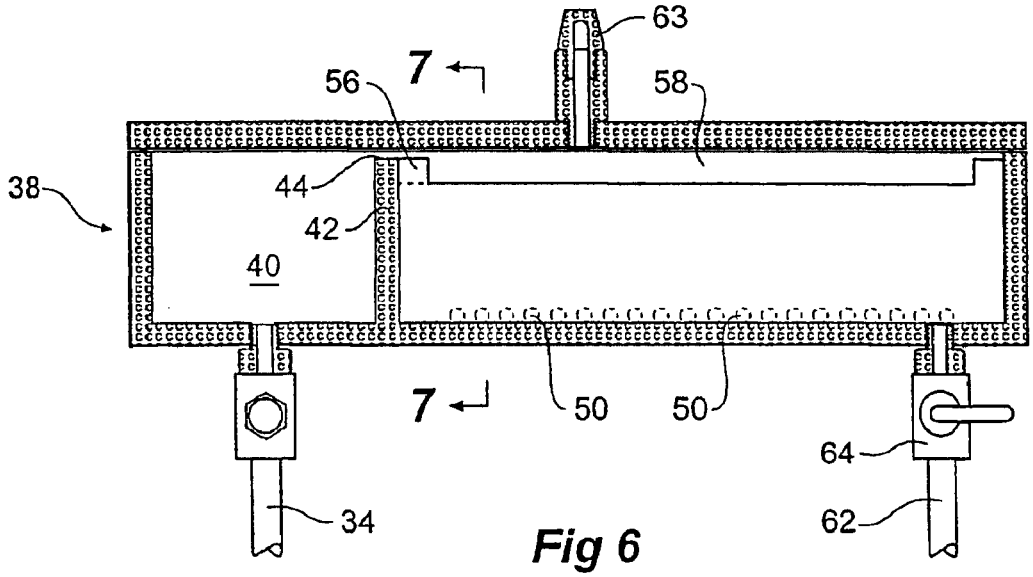
FIG. 6 illustrates the reservoir of FIG. 2 in cross sectional side view.
Figure 7:
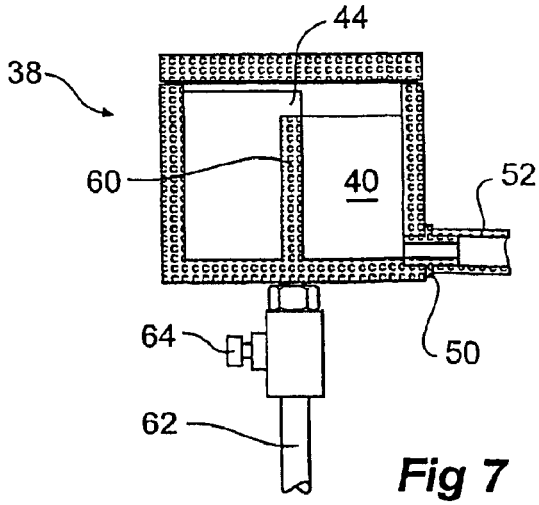
FIG. 7 illustrates the ink reservoir of FIG. 2 in cross section.

A front wall of the outlet chamber 46 is defined by partition 56. As illustrated in FIG. 3 the partition 56 extend only partially towards an upper edge of the reservoir 38 leaving a gap 58. The partition 56 is thus lower than the partition 42. It is also to be noted that the partition 56 has a horizontal upper edge.

The partition 56 separates the outlet chamber 46 from an overflow chamber 60. Thus, as liquid rises in the outlet chamber 46 the liquid overflows into the overflow chamber 60 through the gap 58. Liquid in the overflow chamber 60 can be returned to the first ink supply reservoir that connects to a return supply line 62, which in turn is attached to the return inlet 32 on the first ink supply reservoir 22. A simple valve 64 regulates liquid return from the overflow chamber 60 through the return supply line 62 to the first ink supply reservoir 22. The valve 64 is located in the return supply line 62 immediately below the chamber 64.

Finally, the ink supply reservoir 38 is fitted with a close fitting cover supplied with a pressure release breather valve 63. The breather valve 63 assists in cleaning the print heads 20 in use as described below.

The print unit 18 and the second ink supply reservoir 38 are carried on either side of a common arm 65 on the pedestal 24. The height of the arm 65 is adjustable and can be raised or lowered using a locking screw mechanism 66. A separate air ram 68 fixed to the pump housing 30 is connected to the print head array so as to be able to lift the array for cleaning purposes.

The print heads 20 are of a known, commercially available kind and are each held in respect print head carrier 70. In turn the print head carriers 70 and the associated print heads 20 are secured in a print head array assembly plate 72 or 74. The print head array assembly plates 72/74 housed in the base of the print unit 18. The upper portion of the print unit 18 houses circuit boards and associated cabling for the operation and control of the print heads 20.

Figure 8:
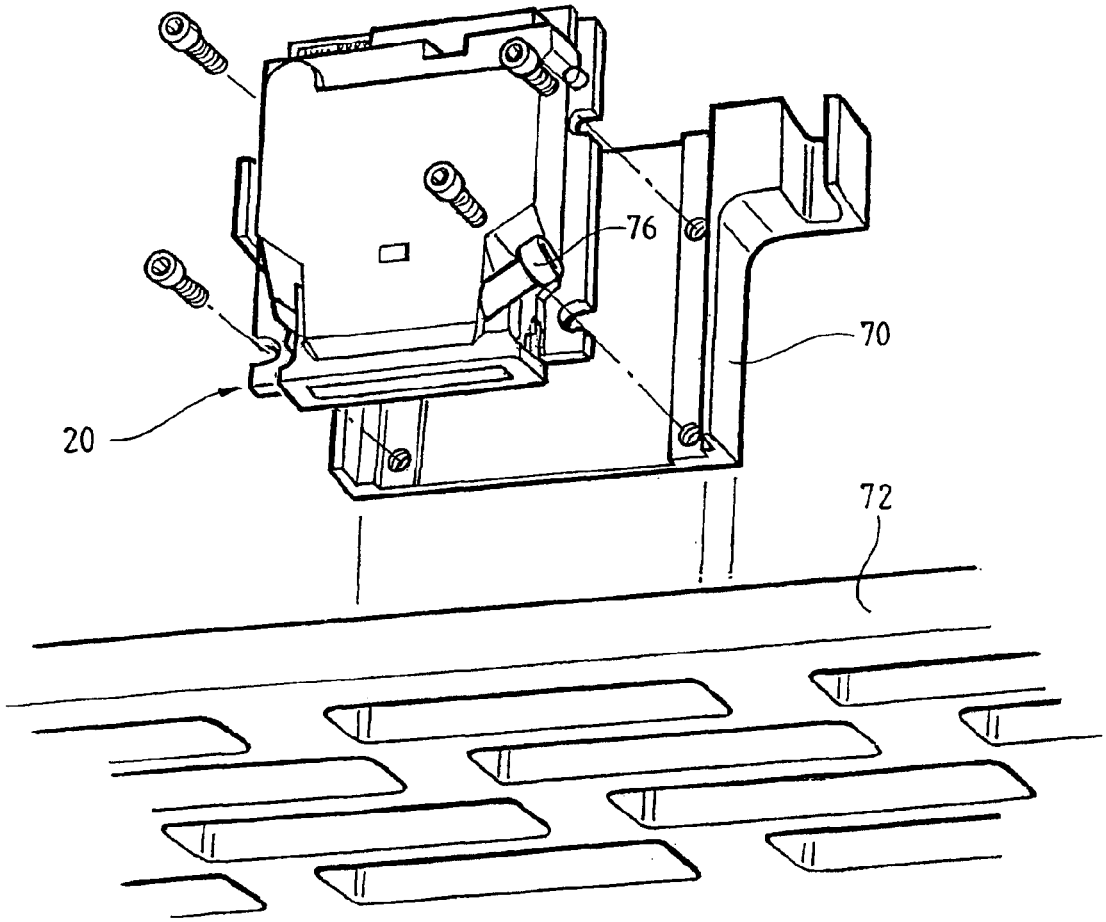
FIG. 8 depicts a print head carrier and a first embodiment of a print head array assembly plate.
Figure 10:
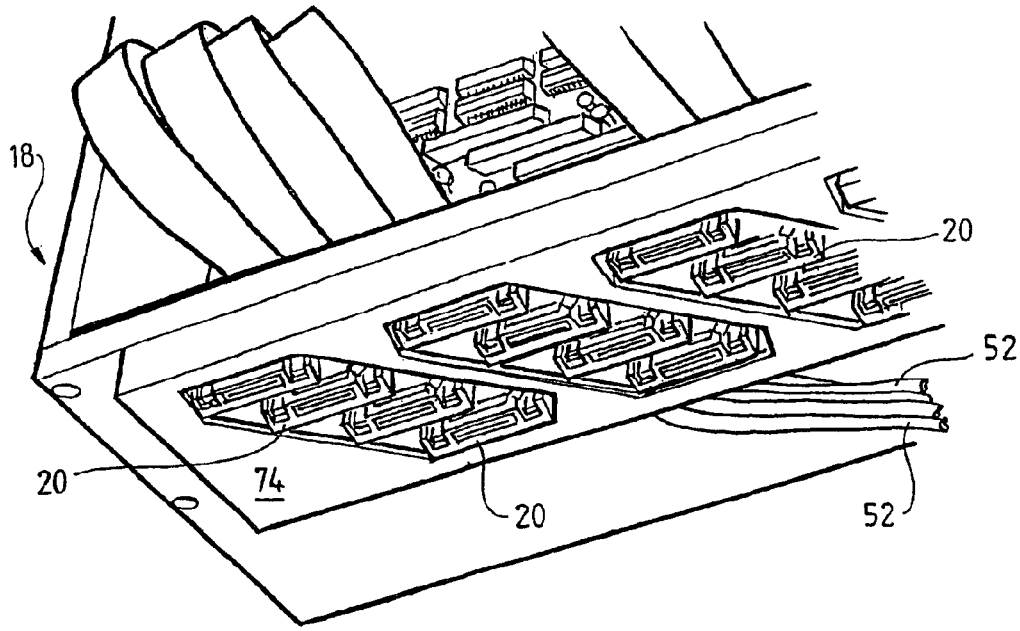
FIG. 10 shows a second embodiment of a print head array assembly plate.
Figure 11:
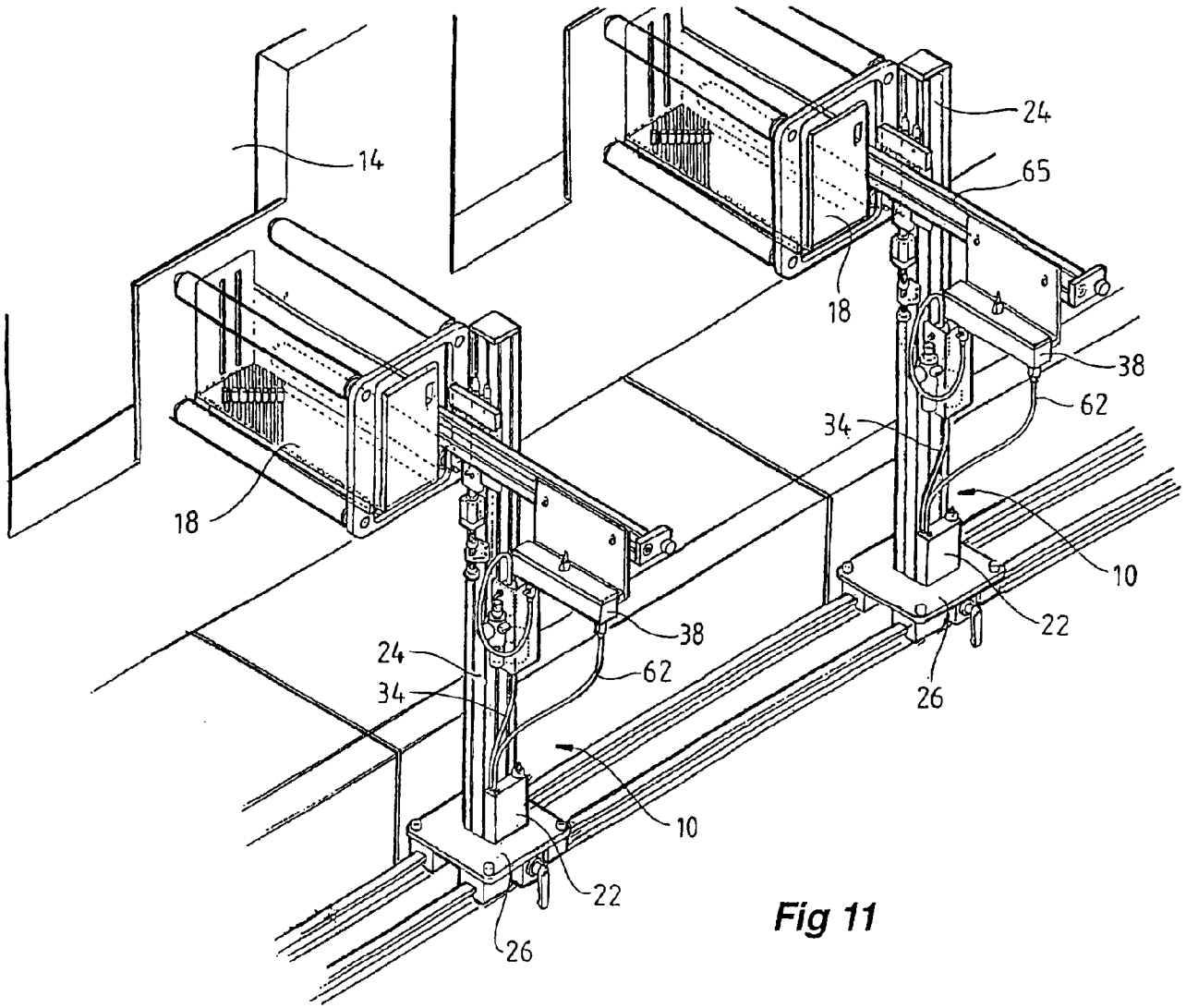
FIG. 11 illustrates the use of a plurality of print stations on a form collator.

Two different types of print head array assembly plate are shown. In FIG. 8 a plate 72 having an array or print heads 20 arranged normally to the print direction is shown together with the print head carrier 70 and mounting screws. In FIG. 10 a plate 74 with an array arranged at an angle to the direction of print is shown mounted into the print unit 18 with the print heads 20 installed. The angled arrangement allows for a printing quality of up to 260 dpi compared with 285 dpi on the parallel arrangement of FIG. 8.

The ink supply lines 52 are fed to each print head into an inlet port 76 located on one side face of the print heads 20.

In use, when the printer is initialised it is important to establish an ink flow through the system. The ink return line 62 connected to the return inlet 32 is closed to ensure that ink does not flow through to the ink supply reservoir 22. The breather valve 63 on the second ink supply reservoir 38 is opened and the pump actuated. The second ink supply reservoir 38 is thus charged with liquid such that the outlet chamber 46 is maintained to the top of the partition 56 with any overflow going to the overflow chamber 60. This level is maintained during the printing process. Thus, the head pressure exerted on each of the outlet flow lines 52 from the outlet openings 50 is constant throughout the printing process.

Figure 9:
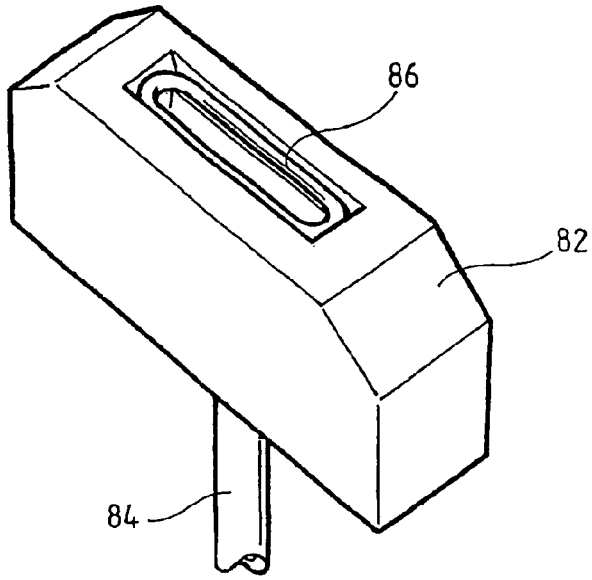
FIG. 9 shows a print head cleaning assembly.

Ink is forced through the system and eventually through the print heads 20. In bleeding through the print heads 20 is collected in tray 80. The system is now charged with ink and the return valve line 64 is opened. An alternative device 82 illustrated in FIG. 9 can be used to assist in cleaning the print heads. The device is attached to a vacuum line 84 leading form vacuum pump 86 and is used to remove excess ink from each print head 20. The device 82 has an aperture 88 which slots neatly onto the print head for cleaning purposes.

The print heads 20 are cleaned with a lint free cloth to collect any excess ink. This is achieved by using the air ram 68 to lift the print heads by 25 mm.

Thus, the combination of chambers and maintenance of liquid level in the outlet chamber produces a non-turbulent even flow of liquid to each print head in the system. It will also be appreciated that the use of a common arm to support both the print head array and the ink supply ensures that the relative levels of the ink in the outlet chamber 46 and the print heads remains constant.

Modifications and variations of the present invention such as would be apparent to a skilled addressee are deemed to be within the scope of the invention.

What is claimed is:

1. An ink supply system comprising:

a first ink supply reservoir, said first ink supply reservoir being in fluid communication with a second ink supply reservoir, pump means associated with said first and second ink supply reservoirs to enable flow of ink from the first ink supply reservoir to the second ink supply reservoir;

said second ink supply reservoir serving to supply ink to a print head, said second ink supply reservoir including an inlet chamber into which ink from the first ink supply reservoir is received and an outlet chamber, the outlet chamber having a one or more outlets;

the one or more outlets, each outlet being adapted to supply ink to a respective print head of print heads;

wherein the inlet and outlet chambers are arranged such that a constant level of ink can be maintained in the outlet chamber during use.

2. An ink supply system according to claim 1, wherein the inlet and outlet chambers of the second ink supply reservoir are adjoining one another and are connected by means of a partition extending therebetween, whereby ink in the inlet chamber overflows the partition into the outlet chamber as the level of ink in the inlet chamber rises.

3. A modular printing station adapted for use with a single or multi-layer high speed printer, said modular printing station comprising a support pedestal having an ink supply system according to claim 2 and an array of print heads mounted adjustably thereon such that a constant level relationship is maintained between the ink supply and the print heads, the print head array being slidably movable between operational and non operational positions; wherein, in an operational position, the print head array is received in a print station mounted on an existing paper flow collator.

4. An ink supply system according to claim 2, wherein the overflow chamber is positioned adjacent the outlet chamber and a barrier between the outlet and overflow chambers establishes an upper level of the outlet chamber, ink being allowed to flow over the barrier to the overflow chamber to preserve a constant level of ink in the outlet chamber.

5. An ink supply system according to claim 4, wherein the partition between the inlet and outlet chambers is higher than the barrier between the outlet and overflow chambers.

6. An ink supply system according to claim 1, wherein an ink level in the outlet chamber is maintained at a constant level by means of an overflow chamber, within the second ink supply reservoir.

7. An ink supply system according to claim 6, wherein the overflow chamber is in fluid communication with the first ink supply reservoir and that ink in the overflow chamber is thereby able to flow from the overflow chamber to the first ink supply reservoir.

8. An ink supply system according to claim 7, wherein flow from the overflow chamber to the first ink supply reservoir is regulated by a control valve.

9. An ink supply system according to claim 8, wherein the height of the common support arm is adjustable with respect to the a pedestal on which the common support arm is mounted without alteration of the relative heights of the ink level in the second ink supply reservoir and the print heads.

10. An ink supply system according to claim 1, wherein the second ink supply reservoir is fitted with a close fitting cover supplied with a pressure release breather valve.

11. An ink supply system according to claim 1, wherein the pumping means is preferably a diaphragm pump.

12. An ink supply system according to claim 1, wherein an in line filter is associated with the pumping means and is positioned between the first ink supply reservoir and the second ink supply reservoir.

13. An ink supply system according to claim 1, wherein the ink level in the second ink supply reservoir is maintained at a constant level with respect to the a height of each print head.

14. An ink supply system according to claim 1, wherein said second ink supply reservoir is held on a printing station on a common support arm with the each print head.

15. An ink supply system according to claim 1, wherein the outlet chamber of the second ink supply reservoir has a respective outlet for each of print heads held in a print head array.

16. A modular printing station adapted for use with a single or multi-layer high speed printer, said modular printing station comprising a support pedestal having an ink supply system according to claim 1 and an array of print heads mounted adjustably thereon such that a constant level relationship is maintained between the second ink supply reservoir and the print heads, the print head array being slidably movable between operational and non operational positions; wherein, in an operational position, the print head array is received in a print station mounted on an existing paper flow collator.

17. A modular printing station as defined in claim 16, wherein the print head array is a sheet having an array of mounting sites therein, a single mounting site serving for each print head and a print head being secured therein by means of a respective print head carrier.

18. A modular printing station according to claim 17, wherein the print head array includes a number of columns of print heads each aligned with a print direction, successive columns being staggered with respect to a preceding column to produce an unbroken print line.

19. A modular printing station according to claim 18, wherein the print head array is be arranged as a plurality of columns, each column being staggered with respect to the preceding column and being arranged at an angle of between 25–65° to the print direction.

20. Printing apparatus comprising a plurality of modular printing stations, each printing station including an ink supply system as defined in claim 1, wherein each print station has an associated station receiving assembly mounted on a multi-sheet form collator to enable high speed multi-layer printing.

* * * * *